US005580849A

United States Patent [19]

Dyet et al.

[11] Patent Number: 5,580,849

[45] Date of Patent: Dec. 3, 1996

[54] LIQUID OR GEL DETERGENT COMPOSITIONS CONTAINING CALCIUM AND STABILIZING AGENT THEREOF

[75] Inventors: Julie A. Dyet, Sunningdale; Peter R. Foley; Fiona A. Fraser, both of So. Gosforth, all of United Kingdom; Bruce P. Murch; Kofi Ofosu-Asante, both of Cincinnati, Ohio; Thomas R. Rolfes, Wyoming, Ohio; Joanna M. Clarke, Jesmond, United Kingdom

[73] Assignee: The Procter & Gamble Company, Cincinnati, Ohio

[21] Appl. No.: 392,836

[22] PCT Filed: Aug. 25, 1993

[86] PCT No.: PCT/US93/07994

§ 371 Date: Feb. 28, 1995

§ 102(e) Date: Feb. 28, 1995

[87] PCT Pub. No.: W094/05758

PCT Pub. Date: Mar. 17, 1994

[30] Foreign Application Priority Data

Sep. 1, 1992 [EP] European Pat. Off. ..... 92870139

[51] Int. Cl.[6] ..... C11D 1/12; C11D 3/04; C11D 3/32

[52] U.S. Cl. ..... 510/427; 510/433; 510/434

[58] Field of Search ..... 252/548, 174.19, 252/550, 551, 548, 174.19

[56] References Cited

U.S. PATENT DOCUMENTS

| | | | |
|---|---|---|---|
| 4,318,818 | 3/1982 | Letton e tal. | 252/174.12 |
| 4,529,525 | 7/1985 | Dormal et al. | 252/132 |
| 5,057,246 | 10/1991 | Bertho et al. | 252/545 |
| 5,223,179 | 6/1993 | Connor et al. | 252/548 |
| 5,376,310 | 12/1994 | Cripe et al. | 252/548 |
| 5,378,409 | 1/1995 | Ofosu-Asante | 252/548 |

FOREIGN PATENT DOCUMENTS

| | | | |
|---|---|---|---|
| 03246265 | 11/1991 | Japan . | |
| 1348212 | 3/1974 | United Kingdom | C11D 3/28 |
| W092/06171 | 4/1992 | WIPO | C11D 17/00 |
| W092/06172 | 4/1992 | WIPO | C11D 17/00 |
| W092/06162 | 4/1992 | WIPO | C11D 3/00 |
| W092/06156 | 4/1992 | WIPO | C11D 1/65 |
| W094/02580 | 3/1994 | WIPO | C11D 3/0084 |
| W095/07332 | 3/1995 | WIPO | C11D 1/65 |

*Primary Examiner*—Erin M. Harriman
*Attorney, Agent, or Firm*—Jerry J. Yetter; T. David Reed

[57] ABSTRACT

Liquid or gel detergent compositions having improved physical stability comprise, by weight of the composition: (a) from about 3% to about 95% of anionic sulfate or sulfonate surfactant; (b) from about 3% to about 40% polyhydroxyfatty acid amide nonionic surfactant; (c) from about 0.1% to about 3% of calcium or strotium ions; (d) from 0.05% to 10% of malic or maleic acid at a molar ratio with calcium of from 0.01:1 to 10:1.

5 Claims, No Drawings

LIQUID OR GEL DETERGENT COMPOSITIONS CONTAINING CALCIUM AND STABILIZING AGENT THEREOF

TECHNICAL FIELD

The present invention relates to liquid or gel detergent compositions containing anionic sulfate or sulfonate surfactant, divalent ions selected from calcium ions and strontium ions, and a stabilizing agent thereof.

BACKGROUND OF THE INVENTION

Detergent compositions containing polyhydroxy fatty acid amide and anionic sulfate surfactant are known from International Application WO 92-06162.

Copending U.S. patent application Ser. No. 07/755900, it has been disclosed that the addition of calcium to detergent compositions containing polyhydroxy fatty acid amide and anionic sulfate surfactant can improve the removal of greasy soils while delivering good hand mildness in particular when calcium ions are added to light duty liquid dishwashing compositions containing polyhydroxy fatty acid amide and anionic sulfate surfactant, surprisingly improved greasy soil removal from dishes was found.

It is known however that calcium is difficult to formulate into a stable liquid composition; copending U.S. patent application Ser. No. 07/755900 proposes to use lime soap dispersing agents for this purpose; in published Canadian Patent Application No. 20550481 it has been proposed to use certain calcium chelating agents in order to stabilize calcium, in liquid detergent compositions containing an alkyl ethoxy carboxylate surfactant.

It has now been found that calcium or strontium ion containing liquid or gel detergent compositions, containing nonionic surfactant and anionic sulfate or sulfonate surfactant, can be remarkably stabilized by the use of a carboxylate which forms a water soluble calcium or strontium salt, most especially by the use of malic, maleic or acetic acid.

Said compositions may be formulated and sold as liquids or gels. Alternatively the compositions may be made up by dissolving a concentrated composition (sold as a concentrate for dilution), which may be solid or liquid, into water containing divalent ions to form a composition in accord with the invention.

The present invention therefore provides remarkably stable liquid or gel detergent compositions which exhibit superior greasy oil removal properties.

DESCRIPTION OF THE INVENTION

The liquid detergent compositions of the present invention comprise, by weight of the composition: (a) from about 3% to about 95% of anionic surfactant selected from anionic sulfate surfactant, anionic sulfonate surfactant, and any mixtures thereof; (b) from about 3% to about 40% of nonionic surfactant, most preferably polyhydroxy fatty acid amide having the formula:

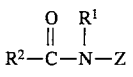

wherein $R^1$ is hydrogen, $C_1$–$C_4$ hydrocarbyl, 2-hydroxyethyl, 2-hydroxypropyl, or mixtures thereof; $R^2$ is $C_5$–$C_{31}$ hydrocarbyl; and Z is a polyhydroxy-hydrocarbyl having a linear hydrocarbyl chain with at least three hydroxyl groups directly connected to the chain, or an alkoxylated derivative thereof; (c) from about 0.1% to about 3% of divalent ions selected from calcium ions, strontium ions, and any mixtures thereof; (d) from 0.05 to 10% of stabilizing agent selected from malic acid, maleic acid, acetic acid, and any mixtures thereof, at a molar ratio with said divalent ion of from 0.01:1 to 10:1.

Anionic Surfactant

The detergent compositions of the present invention comprise from about 3% to about 95%, more preferably from about 5% to about 60%, most preferably from about 10% to about 40%, by weight of anionic surfactant selected from anionic sulfate or sulfonate surfactants, and any mixtures thereof.

Anionic Sulfate Surfactant

The anionic sulfate surfactant may be any organic sulfate surfactant. It is preferably selected from the group consisting of $C_{10}$–$C_{16}$ alkyl sulfate which has been ethoxylated with from about 0.5 to about 20 moles of ethylene oxide per molecule, $C_9$–$C_{17}$ acyl-N-($C_1$–$C_4$ alkyl) glucamine sulfated, —N—($C_2$–$C_4$ hydroxyalkyl) glucamine sulfate, and mixtures thereof. More preferably, the anionic sulfate surfactant is a $C_{10-C16}$ alkyl sulfate which has been ethoxylated with from about 0.5 to about 20, preferably from about 0.5 to about 12, moles of ethylene oxide per molecule.

Alkyl ethoxy sulfate surfactants comprises a primary alkyl ethoxy sulfate derived from the condensation product of a $C_{10-C16}$ alcohol with an average of from about 0.5 to about 20, preferably from about 0.5 to about 12, ethylene oxide groups. The $C_{10}$–$C_{16}$ alcohol itself is commercially available. $C_{12-C14}$ alkyl sulfate which has been ethoxylated with from about 3 to about 10 moles of ethylene oxide per molecule is preferred.

Conventional base-catalyzed ethoxylation processes to produce an average degree of ethoxylation of 12 result in a distribution of individual ethoxylates ranging from 1 to 15 ethoxy groups per mole of alcohol, so that the desired average can be obtained in a variety of ways. Blends can be made of material having different degrees of ethoxylation and/or different ethoxylate distributions arising from the specific ethoxylation techniques employed and subsequent processing steps such as distillation.

Anionic sulfate surfactants include the $C_9$–$C_{17}$ acyl—N—($C_1$–$C_4$ alkyl) and —N—($C_1$–$C_2$ hydroxyalkyl) glucamine sulfates, preferably those in which the $C_9$–$C_{17}$ acyl group is derived from coconut or palm kernel oil. These materials can be prepared by the method disclosed in U.S. Pat. No. 2,717,894, Schwartz, issued Sep. 13, 1955.

Anionic sulfonate surfactant

Anionic sulfonate surfactant suitable for use herein include essentially any sulfonate surfactants including, for example, the salts (eg: alkali metal salts) of $C_9$–$C_{20}$ linear alkybenzene sulfonates, $C_8$–$C_{24}$ olefin sulfonates, sulfonated polycarboxylic acids, alkyl glycerol sulfonates, fatty acyl glycerol sulfonates, fatty oleyl glycerol sulfonates, paraffin sulfonates, and any mixtures thereof.

The counterion for the anionic surfactant component is preferably selected from calcium, sodium, potassium, magnesium, ammonium, or alkanol-ammonium, and mixtures thereof, with calcium and magnesium being preferred for cleaning and sudsing, respectively.

The detergent composition herein preferably comprise from about 5% to about 65%, preferably from about 20% to about 40%, by weight of a surfactant mixture comprising anionic sulfate surfactant and polyhydroxy fatty acid amide surfactant.

Nonionic surfactant

The compositions of the present invention also comprise from about 3% to about 40%, preferably from about 5% to about 30%, more preferably from about 8% to about 25%, by weight of nonionic surfactant.

Polyhydroxy fatty acid amide

Polyhydroxy fatty acid amides are preferred nonionic surfactants for use in accord with the invention.

Polyhydroxy fatty acid amides useful herein have the structural formula:

$$R^2-\overset{\overset{\displaystyle O}{\|}}{C}-\overset{\overset{\displaystyle R^1}{|}}{N}-Z \qquad (I)$$

wherein: R1 is H, $C_1$–$C_4$ hydrocarbyl, 2-hydroxy ethyl, 2-hydroxy propyl, or a mixture thereof, preferable $C_1$–$C_4$ alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_7$–$C_{19}$ alkyl or alkenyl, more preferably straight-chain $C_9$–$C_{17}$ alkyl or alkenyl, most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH2—OH_2$, $—CH(CH_2OH)—(CHOH)_n—$, $—CH_2OH$, $—CH_2—(CHOH)_2(CHOR')(CHOH)—CH_2OH$, where n is an integer from 3 to 5, inclusive, and R' is H or a cyclic or aliphatic monosaccharide, and alkoxylate derivative thereof. Most preferred are glycityls wherein n is 4, particularly $—CH_2—(CHOH)_4—CH_2OH$.

In Formula (I), $R^1$ can be, for example, N-methyl, N-ethyl, N-propyl, N-isopropyl, N-butyl, N-2-hydroxy ethyl, or N-2-hydroxy propyl. R2—CO—N< can be, for example, cocamide, stearamide, oleamide, lauramide, myristamide, capricamide, palmitamide, tallowamide, etc. Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

The most preferred polyhydroxy fatty acid amide has the general formula:

$$R^2-\overset{\overset{\displaystyle O}{\|}}{C}-\overset{\overset{\displaystyle CH_3}{|}}{N}-CH_2-(CHOH)_4CH_2OH$$

wherein $R^2$ is a straight chain $C_{11}$–$C_{17}$ alkyl or alkenyl group.

Divalent ions

From 0.05% to 3%, more preferably from 0.15% to 2% of divalent ion, selected from calcium or strontium ions, or mixtures thereof, is included in the detergent compositions herein. It has been found for compositions containing polyhydroxy fatty acid amide that the presence of calcium greatly improves the cleaning of greasy soils. This is especially true when the compositions are used in softened water, which contains few divalent ions.

The calcium or strontium ions can be added as inorganic salts.

The calcium ions can be added, for example, as a chloride, hydroxide, oxide, formate or acetate, or nitrate salt. If the anionic surfactants are in the acid form, the calcium can be added as a calcium oxide or calcium hydroxide slurry in water to neutralise the acid.

The calcium ions may be present in the compositions as salts. The amount of calcium ions present in compositions of the invention may be dependent upon the amount of total anionic surfactant present herein. The molar ratio of calcium ions to total anionic surfactant is preferably from 1:0.1 to 1:25, more preferably from 1:2 to 1:10, for compositions of the invention.

Stabilizing agent

It has been found that the inclusion of malic, maleic or acetic acid stabilizing agent in the present composition gives excellent calcium or strontium stability results. The stabilizing agent should be present at levels of from 0.05% to 10% of the composition and a molar ratio with calcium of from 0.01:1 to 10:1.

Optional suds-enhancing agents

The surfactant mixture of the present invention preferably further comprises from 1% to 20%, more preferably from 2% to 20% by weight of a suds enhancing agent selected from the group consisting of amine oxides, betaines, sultaines, complex betaines, and certain nonionics. Amine oxides useful in the present invention include those compounds having the formula:

$$R^3(OR^4)_xN(\overset{\overset{\displaystyle O}{|}}{R^5})_2$$

wherein $R^3$ is selected from an alkyl, hydroxyalkyl, acylamidopropoyl and alkyl phenyl group, or mixtures thereof, containing from 8 to 26 carbon atoms, preferably 8 to 16 carbon atoms; $R^4$ is an alkylene or hydroxyalkylene group containing from 2 to 3 carbon atoms, preferably 2 carbon atoms, or mixtures thereof; x is from 0 to 3, preferably 0; and each $R^5$ is an alkyl or hydyroxyalkyl group containing from 1 to 3, preferably from 1 to 2 carbon atoms, or a polyethylene oxide group containing from 1 to 3, preferable 1, ethylene oxide groups. The $R^5$ groups can be attached to each other, e.g., through an oxygen or nitrogen atom, to form a ring structure. These amine oxide surfactants in particular include $C_{10}$–$C_{18}$ alkyl dimethyl amine oxides and $C_8$–$C_{12}$ alkoxy ethyl dihydroxyethyl amine oxides. Examples of such materials include dimethyloctylamine oxide, diethyldecylamine oxide, bis-(2-hydroxyethyl)dodecylamine oxide, dimethyldodecylamine oxide, dipropyltetradecylamine oxide, methylethylhexadecylamine oxide, dodecylamidopropyl dimethylamine oxide and dimethyl-2-hydroxyoctadecylamine oxide. Preferred are $C_{10}$–$C_{18}$ alkyl dimethylamine oxide, and $C_{10-18}$ acylamido alkyl dimethylamine oxide. The betaines useful in the present invention are those compounds having the formula $R(R')_2N^+R^2COO—$ wherein R is a $C_6$–$C_{18}$ hydrocarbyl group, preferably a $C_{10}$ –$C_{16}$ alkyl group or $C_{10-16}$ acylamido alkyl group, each $R^1$ is typically $C_1$–$C_3$ alkyl, preferably methyl,m and $R^2$ is a $C_1$–$C_5$ hydrocarbyl group, preferably a $C_1$–$C_3$ alkylene group, more preferably a $C_1$–$C_2$ alkylene group. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4[$C_{14-16}$ acylmethylamidodiethylammonio]-1-carboxybutane; $C_{16-18}$ acylamidodimethylbetaine; $C_{12-16}$ acylamidopentanediethylbetaine; [$C_{12-16}$ acylmethylamidodimethylbetaine. Preferred betaines are $C_{12-18}$ dimethylammonio hexanoate and the $C_{10-18}$ acylamidopropane (or ethane) dimethyl (or diethyl) betaines.

The sultaines useful in the present invention are those compounds having the formula $(R(R^1)_2N^+R^2SO_3^-$ wherein R is a $C_6$–$C_{18}$ hydrocarbyl group, preferably a $C_{10}$ –$C_{16}$ alkyl group, more preferably a $C_{12}$–$C_{13}$ alkyl group, each $R^1$ is typically $C_1$–$C_3$ alkyl, preferably methyl, and $R^2$ is a $C_1$–$C_6$ hydrocarbyl group, preferably a $C_1$–$C_3$ alkylene or, preferably, hydroxyalkylene group. Examples of suitable sultaines include $C_{12}$ –$C_{14}$ dimethylammonio-2-hydroxypropyl sulfonate, $C_{12-14}$ amido propyl ammonio-2-hydroxypropyl sultaine, $C_{12-14}$ dihydroxyethylammonio propane sulfonate, and $C_{16-18}$ dimethylammonio hexane sulfonate, with $C_{12-14}$ amido propyl ammonio-2-hydroxypropyl sultaine being preferred.

The complex betaines for use herein have the formula $$R-(A)_n-[\underset{\underset{B}{|}}{N}-(CHR_1)_x]_y-\underset{\underset{B}{|}}{N}-Q \qquad (I)$$

wherein R is a hydrocarbon group having from 7 to 22 carbon atoms, A is the group (C(O)), n is 0 or 1, $R_1$ is hydrogen or a lower alkyl group, x is 2 or 3, y is an integer of 0 to 4, Q is the group —$R_2$COOM wherein $R_2$ is an alkylene group having from 1 to 6 carbon atoms and M is hydrogen or an ion from the groups alkali metals, alkaline earth metals, ammonium and substituted ammonium and B is hydrogen or a group Q as defined.

An example in this category is tallowamphopolycarboxy glycinate, of the formula:

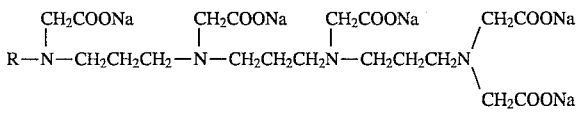

Suitable nonionic detergent surfactants are generally disclosed in U.S. Pat. No. 3,929,678, Laughlin et al., issued Dec. 30, 1975, at column 13, line 14 through column 16, line 6, incorporated herein by reference. Exemplary, non-limiting classes of useful nonionic surfactants are listed below.

1. The polyethylene, polypropylene, and polybutylene oxide condensates of alkyl phenols. In general, the polyethylene oxide condensates are preferred. These compounds include the condensation products of alkyl phenols having an alkyl group containing from about 6 to about 12 carbon atoms in either a straight chain or branched chain configuration with the alkylene oxide. In a preferred embodiment, the ethylene oxide is present in an amount equal to from about 5 to about 25 moles of ethylene oxide per mole of alkyl phenol. Commercially available nonionic surfactants of this type include Igepal™ CO-630, marketed by the GAF Corporation; and Triton™ X-45, X-114, X-100, and X-102, all marketed by the Rohm & Haas Company.

2. The alkyl ethoxylate condensation products of aliphatic alcohols with from about 1 to about 25 moles of ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from 10 to 20 carbon atoms with from about 2 to about 10 moles of ethylene oxide per mole of alcohol. Most preferred are the condensation products of alcohols having an alkyl group containing from 10 to 14 carbon atoms with from about 6 to about 10 moles of ethylene oxide per mole of alcohol. Examples of commercially available nonionic surfactants of this type include Tergitol™ 15-S-9 (the condensation product of $C_{11}$–$C_{15}$ linear alcohol with 9 moles ethylene oxide), Tergitol™ 24-L-6 NMW (the condensation product of $C_{12}$ –$C_{14}$ primary alcohol with 6 moles ethylene oxide with a narrow molecular weight distribution), both marketed by Union Carbide Corporation; Neodol™ 45-9 (the condensation product of $C_{14}$–$C_{15}$ linear alcohol with 9 moles of ethylene oxide), Neodol™ 23-6.5 (the condensation product of $C_{12}$–$C_{13}$ linear alcohol with 6.54 moles of ethylene oxide), Neodol™ 45-7 (the condensation product of $C_{14}$–$C_{15}$ linear alcohol with 7 moles of ethylene oxide), Neodol™ 45-4 (the condensation product of $C_{14}$–$C_{15}$ linear alcohol with 4 moles of ethylene oxide), marketed by Shell Chemical Company, and Kyro™ EOBN (the condensation product of $C_{13}$–$C_{15}$ alcohol with 9 moles ethylene oxide), marketed by The Procter & Gamble Company.

3. The condensation products of ethylene oxide with a hydrophobic base formed by the condensation of propylene oxide with propylene glycol. The hydrophobic portion of these compounds preferably has a molecular weight of from about 1500 to about 1800 and exhibits water insolubility. The addition of polyoxyethylene moieties of this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially-available Pluronic™ surfactants, marketed by BASF.

4. The condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic™ compounds, marketed by BASF.

5. Alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

Optionally, and less desirably, there can be a polyalkyleneoxide chain joining the hydrophobic moiety and the polysaccharide moiety. The preferred alkyleneoxide is ethylene oxide. Typical hydrophobic groups include alkyl groups, either saturated or unsaturated, branched or unbranched containing from 8 to 18, preferably from 10 to 16, carbon atoms. Preferably, the alkyl group is a straight-chain saturated alkyl group. The alkyl group can contain up to about 3 hydroxyl groups and/or the polyalkyleneoxide chain can contain up to about 10, preferably less than 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galatoses. Suitable mixtures include coconut alkyl, di-, tri-, tetra-, and pentaglucosides and tallow alkyl tetra-, penta- and hexaglucosides.

The preferred alkylpolyglycosides have the formula $$R^2O(C_nH_{2n}O)t(glycosyl)_x$$

wherein R2 is selected from the group consisting of alkyl, alkylphenyl, hydroxyalkyl, hydroxyalkylphenyl, and mixtures thereof in which the alkyl groups contain from 10 to 18, preferably from 12 to 14, carbon atoms; n is 2 or 3, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-,3-, 4- and/or 6-position, preferably predominantly the 2-position. 6. Fatty acid amide surfactants having the formula:

$$R^6-\overset{\overset{\displaystyle O}{\|}}{C}-N(R^7)2$$

wherein $R^6$ is an alkyl group containing from 7 to 21, preferably from 9 to 17 carbon atoms and each $R^7$ is selected from the group consisting of hydrogen, $C_1$–$C_4$ alkyl, $C_1$–$C_4$ hydroxyalkyl, and —$(C_2H_4O)_xH$, where x is in the range of from 1 to 3. Preferred amides are $C_8$–$C_{20}$ ammonia amides, monoethanolamides, diethanolamides, and isopropanolamides. Preferred suds enhancing agents are $C_{10-18}$ acyl amide alkyl dimethyl amine oxides, betaines, sultaines, condensation products of aliphatic alcohols with ethylene oxides, and alkylpolysaccharides, and mixtures thereof.

Optional maqnesium

From 0.01% to 3%, most preferably from 0.15% to 0.9%, by weight, of magnesium ions are preferably added to the liquid detergent compositions of the invention for improved product stability, as well as improved sudsing and skin mildness.

If the anionic surfactants are in the acid form, then the magnesium can be added by neutralization of the acid with a magnesium oxide or magnesium hydroxide slurry in water. Calcium can be treated similarly. This technique minimises the addition of chloride ions, which reduces corrosive properties. The neutralized surfactant salts and the hydrotrope are then added to the final mixing tank and any optional ingredients are added before adjusting the pH.

Composition pH

The liquid detergent compositions hereof will preferably be formulated such that during use in aqueous cleaning operations, the wash water will have a pH of between about 5.0 and about 8.0. The liquid compositions themselves preferably have a pH in a 10% solution water at 20° C. of between about 5.5 and about 8.5, most preferably between about 6.8 and about 7.8.

Techniques for controlling pH at recommended usage levels include the use of buffers, alkali, acids, etc., and are well known to those skilled in the art. Dilute hydrochloric acid is preferred for downward pH adjustment and sodium hydroxide for upward pH adjustment.

Liquid or gel compositions

In a preferred embodiment, the detergent compositions of the present invention are liquid detergent compositions. These preferred liquid detergent compositions comprise from 94% to 35% by weight, preferably from 90% to 40% by weight, most preferably from 80% to 50% by weight of a liquid carrier, e.g., water, preferably a mixture of water and a $C_1$–$C_4$ monohydric alcohol (e.g., ethanol, propanol, isopropanol, butanol, and mixtures thereof), with ethanol being the preferred monohydric alcohol or a mixture of water and $C_1$–$C_4$ dihydric alcohol (eg: propylene glycol). A hydrotrope is typically added to the compositions of the present invention, and may be present at levels of from 0.5% to 10%, preferably from 1% to 5%, by weight. Useful hydrotropes include sodium, potassium, and ammonium xylene sulfonates, sodium, potassium, and ammonium toluene sulfonate, sodium potassium and ammonium cumene sulfonate, and mixtures thereof.

Other compounds useful as hydrotropes herein include polycarboxylates. Some polycarboxylates have calcium chelating properties as well as hydrotropic properties. Particularly useful hydrotropes are alkylpolyethoxypolycarboxylate surfactants of the general formula $$R-O-(\underset{\underset{\displaystyle R_1}{|}}{CH}-\underset{\underset{\displaystyle R_2}{|}}{CH}-O)_x-R_3$$

wherein R is a $C_6$ to $C_{18}$ alkyl group, x ranges from 1 to 24, $R_1$ and $R_2$ are selected from the group consisting of hydrogen, methyl or succinic acid moiety, and mixtures thereof, wherein at least one $R_1$ or $R_2$ is a succinic acid moiety. An example of a commercially available alkylpolyethoxpolycarboxylate which can be employed herein is POLY-TERGENT C, Olin Corporation, Cheshire, Conn.

Another compound useful as a hydrotrope is alkyl amphodicarboxylic acid is of the generic formula:

$$RCNHCH_2CH_2N\begin{matrix}(CH_2)_xCOO^- \\ (CH_2)_xCOOM\end{matrix}$$

wherein R is a $C_8$ to $C_{18}$ alkyl group, x is from 1 to 2, M is preferably chosen from alkali metal, alkaline earth metal, ammonium, mono-, di-, and tri-ethanolammonium, most preferably from sodium, potassium, ammonium, and mixtures thereof with magnesium ions. The preferred alkyl chain length (R) is a $C_{10}$ to $C_{14}$ alkyl group and the dicarboxylic acid functionally is diacetic acid and/or dipropionic acid.

A suitable example of an alkyl amphodicarboxylic acid is the amphoteric surfactant Miranol R 2CM Conc.manufactured by Miranol, Inc., Dayton, N.J.

The detergent compositions of the present invention may also be in the form of a gel. Such compositions are typically formulated in polyakenyl polyether and having a molecular weight of from about 750,000 to about 4,000,000.

Highly preferred examples of these polycarboxylate polymer thickeners are the Carbopol 600 series resins available from B. F. Goodrich. Especially preferred are Carbopol 616 and 617. It is believed that these resins are more highly cross-linked than the 900 series resins and have molecular weights between about 1,000,000 and 4,000,000. Mixtures of polycarboxylate polymers as herein described may also be used in the present invention. Particularly preferred is a mixture of Carbopol 616 and 617 series resins.

The polycarboxylate polymer thickener is utilized preferably with essentially no clay thickening agent. In fact, it has been found that if the polycarboxylate polymers of the present invention are utilized with clay in the composition of the present invention, a less desirable product, in terms of phase instability, results. In other words, the polycarboxylate polymer is preferably used instead of clay as a thickening/stabilizing agent in the present compositions.

If the polycarboxylate polymer is used as a thickening agent in the compositions of the present invention, it is typically present at a level of from about 0.1% to about 10%, preferably from about 0.2% to about 2% by weight.

The Thickening agents are preferably used to provide a yield value of from about 50 to about 350 and most preferably from about 75 to about 250. The yield value is an indication of the shear stress at which the gel strength is exceeded and flow is initiated. It is measured herein with a Brookfield RVT model viscometer with a T-bar B spindle at 25° utilizing a Helipath.

Other optional components

Other Anionic Surfactants

Other anionic surfactants useful for detersive purposes can also be included in the compositions hereof. These can include salts (including, for example, sodium, potassium, ammonium, and substituted ammonium salts such as mono-, di- and triethanolamine salts) of soap, fatty oleyl glycerol sulfates, alkyl phenol ethylene oxide ether sulfates, alkyl phosphates, isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates, sulfates of alkylpolysaccharides such as the sulfates of alkylpolyglucoside (the nonionic nonsulfated compounds being described herein), branched primary alkyl sulfates, alkyl polyethoxy carboxylates such as those of the formula $RO(CH_2CH_2O)_kCH_2COO—M^+$ wherein R is a $C_8$–$C_{22}$ alkyl, k is an integer from 0 to 10, and M is a soluble salt-forming cation, and fatty acids esterified with isethionic acid and neutralized with sodium hydroxide. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

Other Surfactants

Ampholytic surfactants can be incorporated into the detergent compositions hereof. These surfactants can be broadly described as aliphatic derivatives of secondary or tertiary amines, or aliphatic derivatives of heterocyclic secondary and tertiary amines in which the aliphatic radical can be straight chain or branched. One of the aliphatic substituents contains at least about 8 carbon atoms, typically from about 8 to about 18 carbon atoms, and at least one contains an anionic water-solubilizing group, e.g., carboxy, sulfonate, sulfate. See U.S. Pat. No. 3,929,678 to Laughlin et al., issued Dec. 30, 1975 at column 19, lines 18–35 (herein incorporated by reference) for examples of ampholytic surfactants.

Zwitterionic surfactants can also be incorporated into the detergent compositions hereof. These surfactants can be broadly described as derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 to Laughlin et al., issued Dec. 30, 1975 at column 19, line 38 through column 22, line 48 (herein incorporated by reference) for examples of zwitterionic surfactants.

Such ampholytic and zwitteronic surfactants are generally used in combination with one or more anionic and/or nonionic surfactants.

If included in the compositions of the present invention, these optional additional surfactants are typically present at a concentration of from about 1% to about 15%, preferably from about 2% to about 10% by weight.

Detergency builders

Other optional ingredients include detergency builders, either of the organic or inorganic type.

Examples of water-soluble inorganic builders which can be used, either alone or in admixture with themselves or with organic alkaline sequestrant builder salts, are glycine, alkyl and alkenyl succinates, alkali metal carbonates, phosphates, polyphosphates, and silicates. Specific examples of such salts are sodium tripolyphosphate, sodium carbonate, potassium carbonate, sodium pyrophosphate, potassium pyrophosphate, potassium tripolyphosphate, and sodium hexametaphosphate. Examples of organic builder salts which can be used alone, or in admixture with each other, or with the preceding inorganic alkaline builder salts, are alkali metal polycarboxylates, examples of which include, but are not limited to, water-soluble citrates such as sodium and potassium citrate, sodium and potassium tartrate, sodium and potassium nitrilo triacetates, sodium and potassium N-2 (2-hydroxyethyl)-nitrilo diacetates, sodium and potassium di-succinates, such as those described in U.S. Pat. No. 4,663,071 (Bush et al., issued May 5, 1987), the disclosure of which is incorporated herein. Other organic detergency builders, such as water-soluble phosphonates, can be used in the compositions of the present invention.

Detergency builders in general have limited value when the compositions of the present invention are in the form of light duty liquid dishwashing detergent compositions. If included in light duty liquids, these optional builders are typically present at a concentration of from about 0.1% to about 10%, preferably from about 2% to about 5%, by weight.

Other desirable ingredients typically used in the compositions herein include dyes, perfumes and opacifiers.

Opacifiers such as Lytron (Morton Thiokol, Inc.), a modified polystyrene latex, or ethylene glycol distearate can be added, preferably as a last step. Lytron can be added directly as a dispersion with mixing. Ethylene glycol distearate can be added in a molten state with rapid mixing to form pearlescent crystals. Opacifiers useful herein, particularly for light duty liquids, are typically present at levels from about 0.2% to about 10%, preferably from about 0.5% to about 6% by weight.

EXAMPLES

The following examples illustrate the compositions of the present invention, but are not necessarily meant to limit or otherwise define the scope of the invention. All parts, percentages and ratios used herein are by weight unless otherwise specified.

| | % by weight | | | | | | |
|---|---|---|---|---|---|---|---|
| | I | II | III | IV | V | VI | VII |
| | | | | | Comp. | | |
| C12/13 alkyl ethoxy (ave. 0.8) sulphate | 10.0 | 10.0 | 9.0 | 19.0 | 10.0 | 6.0 | 6.0 |
| C12/13 alkyl ethoxy (ave. 3) sulphate | 7.0 | 7.0 | 8.0 | 3.0 | 7.0 | 12.0 | 12.0 |
| C12/14 alkyl | 2.0 | 2.0 | 2.0 | 1.6 | 2.0 | — | — |

-continued

| | % by weight | | | | | | |
|---|---|---|---|---|---|---|---|
| | I | II | III | IV | V | VI | VII |
| amine oxide | | | | | | | |
| C12/14 alkyl di methyl betaine | — | — | — | 2.6 | — | 1.5 | 1.5 |
| C12/14 Ampholak(TM) | — | — | 3.0 | — | — | 1.5 | 1.5 |
| C12 alkyl N—methyl glucamide | 12.0 | 12.0 | 9.0 | 11.0 | 12.0 | 8.0 | 6.0 |
| C10 Alkyl Ethoxylate (ave. 8) | 5.0 | 5.0 | 5.0 | 4.6 | 5.0 | 5.0 | 5.0 |
| $Mg^{++}$ion | 0.6 | 0.6 | 0.3 | 0.3 | 0.6 | 0.6 | 0.6 |
| $Ca^{++}$ion | 0.3 | 0.3 | 0.6 | 0.15 | 0.3 | 0.15 | 0.3 |
| Maleic acid | 0.3 | 0.2 | 0.2 | 0.3 | — | 0.6 | — |
| Acetic Acid | — | — | — | — | — | — | 0.3 |
| Miranol (TM) | — | — | 2.0 | — | — | — | — |
| Polytergent (TM) | — | 2.0 | — | — | — | — | — |

The compositions were prepared by mixing all of the surfactants with the exception of the glucamide. The magnesium and calcium salts were then pre-dissolved into solution together with the maleic acid and added to the surfactant mixture with the remaining components. Finally the pH was trimmed to 7.3 using hydrochloric acid and the viscosity checked.

Stability was monitored by storing samples of each of the compositions at room temperature and at 50° C.

Compositions I to IV all remained as clear, homogeneous, stable liquids for at least 3 weeks at 50° C. and at least 4 weeks at room temperature.

Composition V, which contained no maleic acid, became immediately unstable upon heating to 50° C., and became unstable within 2 days at room temperature.

Compositions VI and VII are clear, homogeneous stable liquid composition in accord with the invention.

We claim:

1. A liquid or gel detergent composition comprising, by weight of the composition:

(a) from 3% to 95% of anionic surfactant selected from anionic sulfate surfactant, anionic sulfonate surfactant, and any mixtures thereof;

(b) from 3% to 40% of a polyhydroxy fatty acid amide surfactant of the formula $$R^2-\overset{\overset{\displaystyle O}{\|}}{C}-\overset{\overset{\displaystyle CH_3}{|}}{N}-CH_2(CHOH)_4CH_2OH$$

wherein $R^2$ is $C_{11}$–$C_{17}$ alkyl;

(c) from 0.05% to 3% of divalent ion selected from calcium ions, strontium ions, and mixtures thereof; and (d) from 0.05% to 10% of stabilizing agent selected from malic acid, maleic acid, and mixtures thereof in a molar ratio with said divalent ion of from 0.01:1 to 10:1.

2. A composition according to claim 1 comprising from 5% to 60% of said anionic sulfate surfactant which is selected from the group consisting of $C_{10}$–$C_{16}$ alkyl sulfate which has been ethoxylated with from 0.5 to 20 moles of ethylene oxide per molecule, $C_9$–$C_{17}$ acyl—N—($C_1$–$C_4$ alkyl) glucamine sulfate, —N—($C_2$–$C_4$ hydroxyalkyl) glucamine sulfate, and mixtures thereof.

3. A composition according to claim 1 comprising from 0.15% to 2% of calcium ions and having a pH in a 10% solution in water at 20° C. of between about 5.5 and about 11.0

4. A composition according to claim 1 further comprising from about 2% to 20% of suds enhancing agent which is a member selected from the group of amine oxides, betaines, sultaines, condensation products of aliphatic alcohols with ethylene oxides, alkyl polysaccharides, and mixtures thereof.

5. A composition according to claim 1 which is a liquid detergent composition, additionally containing a hydrotrope which is a member selected from the group consisting of xylene sulfonates, toluene sulfonates and cumene sulfonates.

* * * * *